US006208827B1

(12) United States Patent
Aslam et al.

(10) Patent No.: US 6,208,827 B1
(45) Date of Patent: Mar. 27, 2001

(54) DUAL FUNCTION AIR SKIVE ASSEMBLY FOR REPRODUCTION APPARATUS FUSER ROLLERS

(75) Inventors: Muhammed Aslam, Rochester; Tsutumu Miura, Pittsford; Bruce D. MacLellan, Ontario, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/197,367

(22) Filed: Nov. 20, 1998

(51) Int. Cl.[7] ..... G03G 15/20
(52) U.S. Cl. ..... 399/323; 271/309; 271/900
(58) Field of Search ..... 399/323, 398; 271/195, 300, 309, 900

(56) References Cited

U.S. PATENT DOCUMENTS

| | | |
|---|---|---|
| 2,950,989 | 8/1960 | Freeman . |
| 3,276,425 | 10/1966 | Rabb . |
| 3,600,215 | 8/1971 | Mervine . |
| 3,907,280 | 9/1975 | Bendall et al. . |
| 3,955,813 | 5/1976 | Edwards . |
| 4,034,977 | 7/1977 | Jahn . |
| 4,168,830 | 9/1979 | Hori et al. . |
| 4,397,258 | 8/1983 | Dremel . |
| 4,420,152 | 12/1983 | Miyashita . |
| 5,031,002 | 7/1991 | Yaguchi . |
| 5,459,562 | 10/1995 | Mitsuya et al. . |
| 5,532,810 | 7/1996 | Cahill . |
| 5,665,160 | 9/1997 | Davene et al. . |

*Primary Examiner*—William Royer
*Assistant Examiner*—Greg Moldafsky
(74) *Attorney, Agent, or Firm*—Lawrence P. Kessler

(57) ABSTRACT

A fuser apparatus having a pair of rollers in nip relation to transport a receiver member therebetween to permanently fix a marking particle image to such receiver member, and a dual function air skive assembly for stripping a receiver member adhering to a fuser apparatus roller from the roller. The dual function air skive assembly includes a frame engageable with a roller of the pair of rollers of the fuser apparatus. An air plenum is supported by the frame in operative relation to the fuser roller nip. The air plenum has a first nozzle arrangement directed at an angle to the roller so as to provide a positive air flow to strip a receiver member adhering to the roller therefrom. The first nozzle arrangement has a plurality of nozzle heads respectively configured to provide a positive air flow having a substantially oval cross-section. A second nozzle arrangement is directed substantially normal to the first nozzle arrangement to provide a positive air flow to cool a stripped receiver member and keep such receiver member from contacting the plenum.

15 Claims, 2 Drawing Sheets

DUAL FUNCTION AIR SKIVE ASSEMBLY FOR REPRODUCTION APPARATUS FUSER ROLLERS

CROSS REFERENCE TO RELATED APPLICATIONS

U.S. Ser. No. 09/197,737, filed Nov. 28, 1998, entitled "DUAL FUNCTION SKIVE ASSEMBLY FOR REPRODUCTION APPARATUS FUSER ROLLERS".

FIELD OF THE INVENTION

The present invention relates in general to a dual function air skive assembly for a fuser roller, and more particularly to an improved nozzle configuration for a dual function air skive which will substantially prevent damage to the roller and to the fused image on the receiver members stripped from the roller.

BACKGROUND OF THE INVENTION

In a typical commercial reproduction apparatus (electrostatographic copier/duplicators, printers, or the like), a latent image charge pattern is formed on a uniformly charged dielectric member. Pigmented marking particles are attracted to the latent image charge pattern to develop such image on the dielectric member. A receiver member is then brought into contact with the dielectric member. An electric field, such as provided by a corona charger or an electrically biased roller, is applied to transfer the marking particle developed image to the receiver member from the dielectric member. After transfer, the receiver member bearing the transferred image is separated from the dielectric member and transported away from the dielectric member to a fuser apparatus at a downstream location. There the image is fixed to the receiver member by heat and/or pressure from the fuser apparatus to form a permanent reproduction thereon.

One type of fuser apparatus, utilized in typical reproduction apparatus, includes at least one heated roller and at least one pressure roller in nip relation with the heated roller. The fuser apparatus rollers are rotated to transport a receiver member, bearing a marking particle image, through the nip between the rollers. The pigmented marking particles of the transferred image on the surface of the receiver member soften and become tacky in the heat. Under the pressure, the softened tacky marking particles attach to each other and are partially imbibed into the interstices of the fibers at the surface of the receiver member. Accordingly, upon cooling, the marking particle image is permanently fixed to the receiver member. It sometimes happens that the marking particles stick to the peripheral surface of the heated roller and result in the receiver member adhering to such roller; or the marking particles may stick to the heated roller and subsequently transfer to the peripheral surface of the pressure roller resulting in the receiver member adhering to the pressure roller. Therefore, a skive mechanism, including mechanical skive fingers (or separator pawls), has been employed to engage the respective peripheral surfaces of the fuser apparatus rollers to strip any adhering receiver member from the rollers in order to substantially prevent receiver member jams in the fuser apparatus. Typically a fuser apparatus skive mechanism includes a plurality of skive fingers. The skive fingers are generally formed as elongated members respectively having a relatively sharp leading edge urged into engagement with a fuser apparatus roller. For example, the skive fingers may be thin, relatively flexible, metal shim stock. The respective leading edge of each of the skive fingers is directed, in the opposite direction to rotation of the fuser apparatus roller with which such skive finger is associated, so as to act like a chisel to strip any receiver member adhering to such roller from the peripheral surface thereof.

However, if the marking particle image is particularly heavy, the receiver member may adhere to a fuser apparatus roller with such force that engagement with the skive fingers does not completely strip the receiver member from the roller. When a receiver member transported through the fuser apparatus is only stripped from a roller by some of the skive fingers (and not by others), the receiver member will cause a jam in the fuser apparatus. This destroys the reproduction formed on the receiver member and shuts down the reproduction apparatus. Moreover, as the receiver member moves with the fuser apparatus roller to which it adheres, the stripped portions of the receiver member are forced into engagement with their associated skive fingers by the non-stripped portions of the receiver member. The engagement force of the receiver member on the skive fingers may be sufficient to flex those skive fingers so as to engage the associated peripheral surface of the fuser apparatus roller at a substantially increased attack angle. This increased attack angle may then damage the roller by gouging its peripheral surface or may damage the skive finger itself. Alternatively, as the receiver member is transported through the fuser apparatus, the receiver member may apply such force to the skive fingers on initial engagement therewith so as to cause such fingers to buckle in the direction which will flex those skive fingers to engage the associated fuser apparatus roller at an increased attack angle. Again, this increased attack angle may damage the roller by gouging its peripheral surface or may damage the skive finger itself.

In order to overcome the problems generated by mechanical skive fingers, another mechanism for stripping receiver members from the rollers of a fuser apparatus has been designed which includes air jets directed at the rollers to strip any adhering receiver member from the rollers (see for example U.S. Pat. No. 4,420,152, issued Dec. 13, 1983, in the name of Miyashita). It provides an air chamber with exhaust nozzles which direct escaping air at high speeds for separating receiver members from the fuser rollers. However such arrangement creates a high pressure area near the fusing nip and a low pressure area adjacent to the air skive. Thus after a receiver member is stripped from a fuser roller it is attracted to the skive structure. Since the skive structure is close to the fuser roller, it is at an elevated temperature. Accordingly, the hot skive structure may scratch the image on the receiver member or damage the receiver member itself.

In copending U.S. patent appliciation Ser. No. 09/197,737, a dual function air skive assembly for stripping a receiver member adhering to a fuser apparatus roller from the roller without damage has been proposed. The dual function air skive assembly includes an air plenum having a first nozzle to provide a positive air flow to strip a receiver member adhering to the roller therefrom, and a second nozzle arrangement to provide a positive air flow to cool a stripped receiver member and keep such receiver member from contacting the plenum. However, while such disclosed dual function air skive provides adequate operation with nominal receiver members, it does not necessarily handle the wide variety of receiver member types required by new reproduction apparatus.

SUMMARY OF THE INVENTION

In view of the above, this invention is directed to a fuser apparatus having a pair of rollers in nip relation to transport a receiver member therebetween to permanently fix a marking particle image to such receiver member, and a dual function air skive assembly for stripping a receiver member adhering to a fuser apparatus roller from the roller. The dual function air skive assembly includes a frame engageable with a roller of the pair of rollers of the fuser apparatus. An air plenum is supported by the frame in operative relation to the fuser roller nip. The air plenum has a first nozzle arrangement directed at an angle to the roller so as to provide a positive air flow to strip a receiver member adhering to the roller therefrom. The first nozzle arrangement has a plurality of nozzle heads respectively configured to provide a positive air flow having a substantially oval cross-section. A second nozzle arrangement is directed substantially normal to the first nozzle arrangement to provide a positive air flow to cool a stripped receiver member and keep such receiver member from contacting the plenum.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
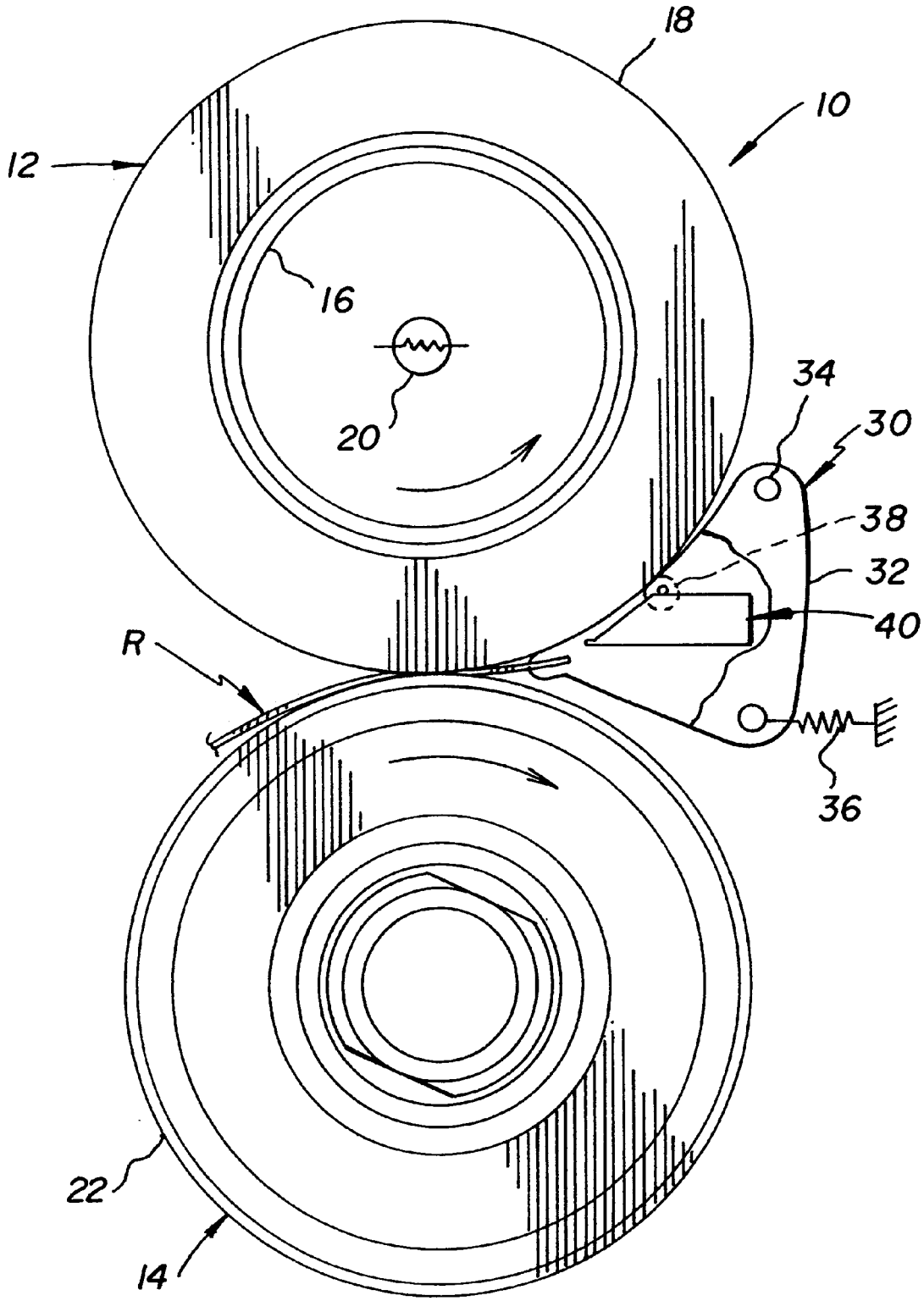
FIG. 1 is a side elevational view of a reproduction apparatus fuser having a dual function air skive assembly, according to this invention, with portions removed or broken away to facilitate viewing.

Referring now to the accompanying drawings, FIG. 1 shows a typical fuser, designated generally by the numeral 10, for a reproduction apparatus. The fuser apparatus 10 includes a fuser roller 12 in nip relation with a pressure roller 14. Rotation of the fuser apparatus rollers by any suitable drive mechanism (not shown) will serve to transport a receiver member (designated by the letter R in FIG. 1), bearing a marking particle image through the nip under the application of heat and pressure. The receiver member may be, for example, a sheet of plain bond paper, or transparency material. The heat will soften the marking particles and the pressure will force the particles into intimate contact and to be at least partially imbibed into the fibers at the surface of the receiver material. Thus, when the marking particles cool, they are permanently fixed to the receiver member in an image-wise fashion.

The fuser roller 12 includes a core 16 and a cylindrical fusing blanket 18 supported on the core. The blanket 18 is typically made of a rubber material particularly formulated to be heat conductive or heat insulative dependent upon whether the fuser heat source is located within the core 16 or in juxtaposition with the periphery of the blanket. In the illustrated preferred embodiment as shown in FIG. 1, the heat source is an internal heater lamp designated by the numeral 20. A well known suitable surface coating (not shown) may be applied to the blanket 18 to substantially prevent offsetting of the marking particle image to the fuser roller 12.

The pressure roller 14 has a hard outer shell 22. Typically, the shell 22 is made of metal, such as aluminum or steel for example. The shell 22 may also have a well known suitable surface coating (not shown) applied thereto to substantially prevent offsetting of the marking particle image to the pressure roller 14. A cleaning assembly (not shown) may be provided to remove residual marking particle, paper fibers, and dust from the fuser apparatus rollers.

As noted above, under certain circumstances, such as when fusing heavy marking particle images, the receiver member may adhere to one or the other of the fuser apparatus rollers (i.e., fuser roller 12 or pressure roller 14). Therefore, a skive mechanism, designated generally by the numeral 30, is provided according to the invention fully described in the aforementioned copending U.S. patent application Ser. No. 09/197,737. The skive mechanism 30, shown in FIG. 1 in operative relation with the fuser roller 12, includes a frame 32 engageable with the fuser roller of the fuser apparatus 10. The frame 32 is mounted on a pivot rod 34 having its longitudinal axis parallel to the longitudinal axis of the fuser roller. A resilient member 36, such as a compression spring, urges the frame 32 in a direction about the pivot rod 34 into engagement with the fuser roller. A follower member 38 is carried by the frame 32 in a manner whereby, under the urging of the resilient member 36, the follower member engages the fuser roller to maintain a predetermined spacing between the frame and the fuser roller.

Figure 2:
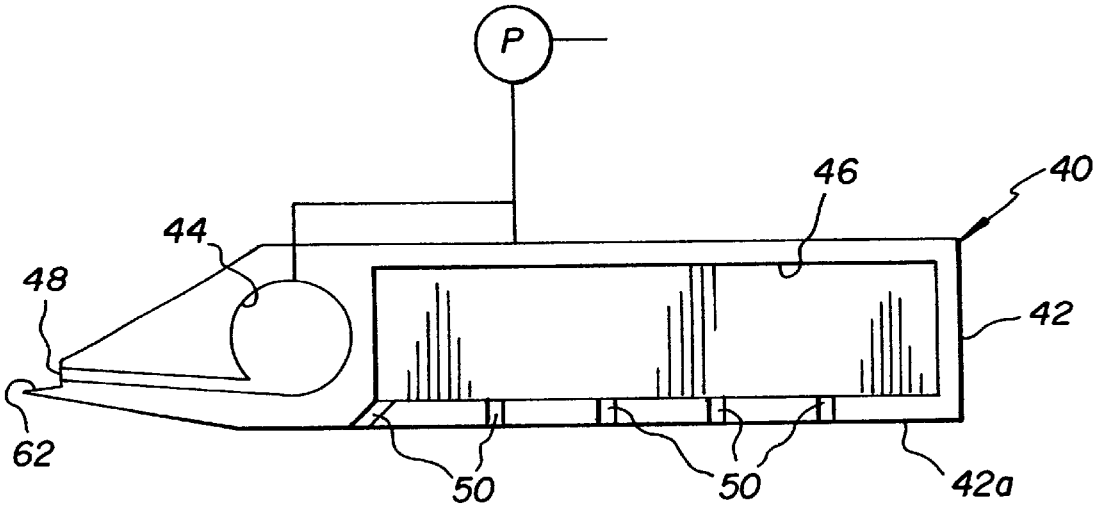
FIG. 2 is a side elevational view, on an enlarged scale, of the air plenum for the dual function air skive assembly, according to this invention, as shown in FIG. 1.

An air plenum 40 is supported by the frame 32 in a particular location relative thereto. Accordingly, when the follower member 38 engages the fuser roller 12, the air plenum 40 is in operative relation to the fuser roller nip. Referring now to FIG. 2, the air plenum 40 has a housing 42 which defines internal chambers 44 and 46. The chambers are in flow communication with a pressurized air source P. The air plenum 40 has a first nozzle arrangement 48, located at one end of the housing 42. The first nozzle arrangement 48 includes a plurality of nozzle heads 60 (see FIGS. 3 and 4) which are particularly configured according to this invention. The nozzle heads 60 of the first nozzle arrangement 48 are aligned along an element parallel to an element of the fuser roller 12, above a forward-extending lip 62. They are directed at an angle to the fuser roller 12 so as to provide a positive air flow to strip a receiver member adhering to the fuser roller therefrom.

Figure 3:
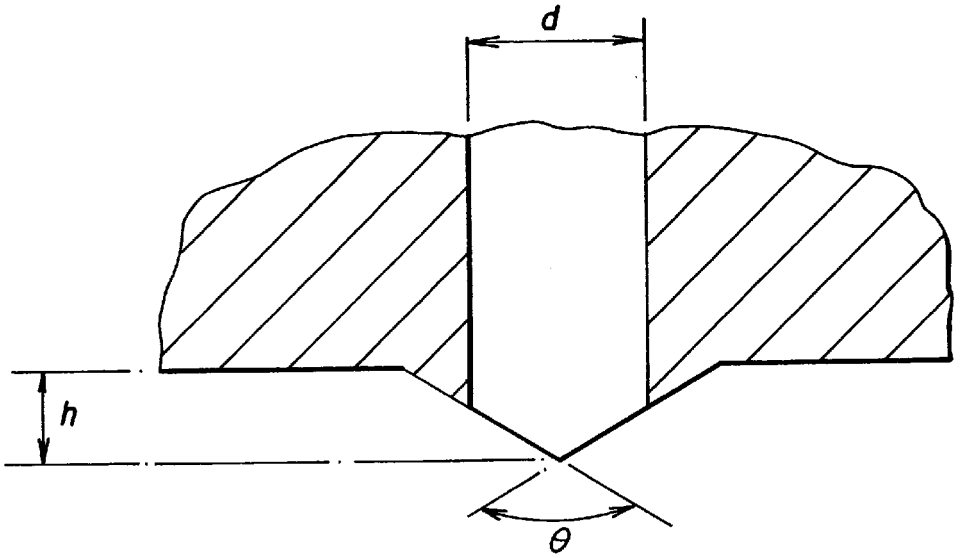
FIG. 3 is a front elevational view, on an enlarged scale, of a portion of the air plenum for the dual function air skive assembly, according to this invention.
Figure 4:
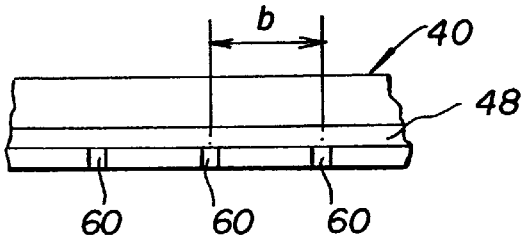
FIG. 4 is a plan view, in cross-section and on an enlarged scale, of an improved nozzle head configuration for the first nozzle arrangement of the air plenum for the dual function air skive assembly, according to this invention.

The shape of each of the nozzle heads 60, according to this invention, is that of a pyramid. As best shown in FIG. 3, this shape causes the positive air flow to assume a pattern which is substantially oval in cross-section. As such, the height of the air flow directed at the fuser roller remains focused to yield optimum separation of the receiver member, but is substantially widened. That is, the air flow is spread out in the dimension along the length of the nozzle element. As a result, the air flow from adjacent nozzle heads will overlap to give a substantially uniform flow for receiver member separation.

The parameters for each of the nozzle heads 60 to optimize air flow is as follows. The diameter of the nozzle port (d) is in the range of between 0.5 mm to 1.0 mm, the pyramid extruded height (h) is in the range of between 0.3 mm to 1.0 mm, and the pyramid angle ($\theta$) is in the range of between 90° and 150°. Further, the distance between adjacent nozzle heads should be in the range of about 8.0 mm to 15.0 mm, and the length of the extending lip 62 is in the range of about 3.0 mm to 8.0 mm. In the preferred working embodiment, the nozzle port (d) is 0.8 mm, the pyramid extruded height (h) is 0.5 mm, the pyramid angle (θ) is 120°, the distance between adjacent nozzle heads (b) is 10.0 mm, and the length of the extending lip 62 is 5.0 mm. Of course, the pyramid shape of the nozzle head could be intruded as well as extruded. However, the intruded shape may result in more turbulent air flow which may be less effective for receiver member separation.

The angle of the first nozzle arrangement is such that the positive air flow acts like a chisel to assure that the lead edge of a receiver member exiting the fusing nip is lifted from the fuser roller. It has been found that the positive air flow should be at a pressure of at least 50 PSI. Further, the angle of impingement of the positive air flow on the fuser roller in the range of between 20° and 28° is highly efficient in assuring separation of the receiver member from the fuser roller.

The air plenum 40 also has a second nozzle arrangement 50. The second nozzle arrangement is located in a wall 42*a* of the housing 42. The second nozzle arrangement 50 includes a plurality of nozzle heads, formed through the wall 42*a* spaced, in parallel rows, in the direction of receiver member movement along a path in juxtaposition with the plenum after the receiver member has been stripped from the fuser roller 12. The nozzle heads of the second nozzle arrangement 50 are directed substantially perpendicular to the heads of the first nozzle arrangement 48, and normal to the path of the stripped receiver member. The positive air flow from the second nozzle arrangement 50 will thus serve to cool a stripped receiver member. This will provide for a more rapid and efficient cooling of the marking particle image to fix the image to the receiver member. Additionally, such positive air flow will keep such receiver member from contacting the wall 42*a* of the plenum housing. As a result, the air plenum housing 42, which may be of an elevated temperature due to its proximity to the fuser nip, will be prevented from scratching the image on the receiver member or damage the receiver member itself as it moves along the path away from the nip of the fuser apparatus 10.

The invention has been described in detail with particular reference to certain preferred embodiments thereof, but it will be understood that variations and modifications can be effected within the spirit and scope of the invention.

What is claimed is:

1. A fuser apparatus having a pair of rollers in nip relation to transport a receiver member therebetween to permanently fix a marking particle image to such receiver member, and a dual function air skive assembly for stripping a receiver member adhering to a fuser apparatus roller from said fuser apparatus roller, said dual function air skive assembly comprising:

a frame engageable with a roller of said pair of rollers of said fuser apparatus; and an air plenum supported by said frame in operative relation to a nip formed by said pair of rollers; said air plenum having a first nozzle arrangement directed at an angle to said roller so as to provide a positive air flow to strip said receiver member adhering to said roller therefrom, said first nozzle arrangement having a plurality of nozzle heads respectively configured to provide a first positive air flow having a substantially oval cross-section, and a second nozzle arrangement directed substantially normal to said first nozzle arrangement to provide a second positive air flow to cool a stripped receiver member and keep such receiver member from contacting said plenum.

2. The dual function air skive according to claim 1 wherein each of said plurality of nozzle heads is of a configuration having a pyramid height in a range of between 0.3 mm to 1.0 mm, and a pyramid angle in a range of between 90° and 150°.

3. The dual function air skive according to claim 1 wherein said plurality of nozzle heads are aligned so as to be parallel to the axial direction of said roller.

4. The dual function air skive according to claim 3 wherein said a plaurality of nozzle heads are respectively spaced apart in a range of about 8.0 mm to 15.0 mm.

5. The dual function air skive according to claim 1 wherein said first nozzle arrangement has said plurality of nozzle heads aligned so as to be parallel to the axial direction of said roller, said pluarality of nozzle heads being respectively spaced apart in a range of about 8.0 mm to 15.0 mm, and located relatively above a forward-extending lip of a dimension in a range of about 3.0 mm to 8.0 mm.

6. The dual function air skive according to claim 1 wherein each of said plurality of nozzle heads is of a configuration having a pyramid height in a range of between 0.3 mm to 1.0 mm, and a pyramid angle in the range of between 90° and 150°, and said plurality of nozzle heads are aligned and respectively spaced apart in the range of about 8.0 mm to 15.0 mm.

7. The dual function air skive according to claim 1 wherein said frame is mounted on a pivot, and is urged in a direction about said pivot into engagement with said roller, and has a follower member adapted to be engaged with said roller to maintain a predetermined spacing between said air plenum supported by said frame and said roller so that the angle of impingement of the first positive air flow from said air plenum on said roller is in range of between 20° and 28°.

8. The dual function air skive according to claim 1 wherein each of said plurality of nozzle heads is of a configuration having a pyramid height in a range of between 0.3 mm to 1.0 mm, and a pyramid angle in a range of between 90° and 150°, said plurality of nozzle heads are aligned so as to be parallel to the axial direction of said roller and respectively spaced apart in a range of about 8.0 mm to 15.0 mm, and wherein said frame is mounted on a pivot, and is urged in a direction about said pivot into engagement with said roller, and has a follower member adapted to be engaged with said roller to maintain a predetermined spacing between said air plenum supported by said frame and said roller so that an angle of impingement of the first positive air flow from said air plenum on said roller is in a range of between 20° and 28°.

9. A fuser apparatus for a reproduction apparatus, said fuser apparatus comprising:

a heated fuser roller;

a pressure roller in nip relation with said heated fuser roller; and a skive mechanism including a frame engageable with a roller which is either said heater fuser roller or said pressure roller, and an air plenum supported by said frame in operative relation to a nip formed by said heated fuser roller and said pressure roller, said air plenum having a first nozzle arrangement directed at an angle to said roller so as to provide a first positive air flow to strip a receiver member adhering to said roller therefrom, said first nozzle arrangement having a plurality of nozzle heads respectively configured to provide said first positive air flow having a cross-section focused in the dimension of height of said positive air flow and spread out in the dimension of width to overlap with adjacent nozzle head air flows, and a second nozzle arrangement directed substantially normal to said first nozzle arrangement to provide a second positive air flow to cool said receiver member and keep such receiver member from contacting said air plenum.

10. The fuser apparatus according to claim 9 wherein said frame is mounted on a pivot, and is urged in a direction about said pivot into engagement with said roller, and has a follower member adapted to be engaged with said roller to maintain a predetermined spacing between said air plenum supported by said frame and said roller so that an angle of impingement of the first positive air flow from said air plenum on said roller is in a range of between 20° and 28°.

11. The fuser apparatus according to claim 9 wherein each of said plurality of nozzel heads is of a configuration having a pyramid height in a range of between 0.3 mm to 1.0 mm, and a pyramid angle in a range of between 90° and 150°, said plurality of nozzle heads are aligned so as to be parallel to the axial direction of said roller and respectively spaced apart in a range of about 8.0 mm to 15.0 mm, and wherein said frame is mounted on a pivot, and is urged in a direction about said pivot into engagement with said roller, and has a follower member adapted to be engaged with said roller to maintain a predetermined spacing between said air plenum supported by said frame and said roller so that an angle of impingement of the first positive air flow from said air plenum on said fuser roller is in a range of between 20° and 28°.

12. A fuser apparatus for permanently fixing a marking particle image to a receiver member, and a dual function air skive assembly for stripping said receiver member adhering to said fuser apparatus, said dual function air skive assembly comprising:

a frame engageable with said fuser apparatus; and an air plenum supported by said frame in operative relation to said fuser apparatus; said air plenum having a first nozzle arrangement directed at an angle to said fuser apparatus so as to provide a first positive air flow to strip said receiver member adhering to said fuser apparatus therefrom, said first nozzle arrangement having a plurality of nozzle heads respectively configured to provide a first positive air flow having a substantially oval cross-section, and a second nozzle arrangement directed substantially normal to said first nozzle arrangement to provide a second positive air flow to cool said stripped receiver member and keep such receiver member from contacting said air plenum.

13. The dual function air skive according to claim 12 wherein each of said pluarity of nozzle heads is of a configuration having a pyramid height in a range of between 0.3 mm to 1.0 mm, and a pyramid angle in a range of between 90° and 150°.

14. The dual function air skive according to claim 12 wherein said first nozzle arrangement has said plurality of nozzle heads respectively spaced apart in the range of about 8.0 mm to 15.0 mm, and located relatively above a forward-extending lip.

15. The dual function air skive according to claim 12 wherein said frame is mounted on a pivot, and is urged in a direction about said pivot into engagement with said fuser apparatus, and has a follower member adapted to be engaged with said fuser apparatus to maintain a predetermined spacing between said air plenum supported by said frame and said fuser apparatus so that an angle of impingement of the first positive air flow from said air plenum on said fuser apparatus is in a range of between 20° and 28°.

* * * * *